US008210319B2

(12) United States Patent
Boyd et al.

(10) Patent No.: US 8,210,319 B2
(45) Date of Patent: Jul. 3, 2012

(54) HYDRAULIC ELEVATING PLATFORM ASSEMBLY

(75) Inventors: John W. Boyd, Denmark, SC (US); William P. Whitwell, Denmark, SC (US); George Hicks, Maylene, AL (US); Ronnie D. Hicks, Brierfield, AL (US); Timothy J. Dimmick, Anderson, SC (US)

(73) Assignee: John W. Boyd, Denmark, SC (US)

( * ) Notice: Subject to any disclaimer, the term of this patent is extended or adjusted under 35 U.S.C. 154(b) by 707 days.

(21) Appl. No.: 11/897,558

(22) Filed: Aug. 31, 2007

(65) Prior Publication Data

US 2009/0057067 A1 Mar. 5, 2009

(51) Int. Cl.
*B66B 9/04* (2006.01)
*B66B 1/32* (2006.01)
*B66B 1/28* (2006.01)

(52) U.S. Cl. ..... 187/253; 187/288; 187/393

(58) Field of Classification Search ..... 187/253, 187/250, 251, 393, 288, 291, 293, 361, 367; 118/321

See application file for complete search history.

(56) References Cited

U.S. PATENT DOCUMENTS

| | | | | | |
|---|---|---|---|---|---|
| 383,715 | A | * | 5/1888 | Ellington | 187/253 |
| 1,281,407 | A | * | 10/1918 | Marques | 118/321 |
| 1,625,123 | A | * | 4/1927 | Horten | 425/449 |
| 3,313,376 | A | | 4/1967 | Holland | |
| 3,691,992 | A | * | 9/1972 | Beemer | 118/107 |
| 3,924,710 | A | | 12/1975 | Shohet | |
| 4,155,431 | A | * | 5/1979 | Johnson | 188/170 |
| 4,697,671 | A | | 10/1987 | Stewart et al. | |
| 4,830,146 | A | * | 5/1989 | Nakamura et al. | 187/253 |
| 4,930,598 | A | | 6/1990 | Murrill et al. | |
| 5,300,737 | A | * | 4/1994 | Nakanishi | 187/289 |
| 5,578,801 | A | * | 11/1996 | Hofmann | 187/393 |
| 5,883,344 | A | * | 3/1999 | Colby et al. | 187/393 |
| 5,901,814 | A | * | 5/1999 | Adifon et al. | 187/253 |
| 5,929,400 | A | * | 7/1999 | Colby et al. | 187/393 |
| 6,123,176 | A | * | 9/2000 | O'Donnell et al. | 187/393 |
| 6,325,179 | B1 | * | 12/2001 | Barreiro et al. | 187/393 |
| 6,523,647 | B2 | | 2/2003 | Duplessis | |
| 7,073,633 | B2 | * | 7/2006 | Weinberger et al. | 187/393 |
| 2005/0042068 | A1 | | 2/2005 | Ehmen | |
| 2007/0151974 | A1 | | 7/2007 | Boyd | |

FOREIGN PATENT DOCUMENTS

| | | | | |
|---|---|---|---|---|
| DE | 3629032 | A1 | * | 4/1988 |
| EP | 0 183 616 | A2 | | 6/1986 |
| EP | 0 957 060 | A1 | | 11/1999 |
| EP | 1870369 | A1 | * | 12/2007 |
| GB | 1 438 727 | A | | 6/1976 |
| WO | WO 2006/008586 | | | 1/2006 |

OTHER PUBLICATIONS

PCT/US2008/010259, Written Opinion of the International Searching Authority, Nov. 5, 2008, 6 pages, ISA/US, Alexandria, Virgina.

(Continued)

*Primary Examiner* — Michael Mansen
*Assistant Examiner* — Stefan Kruer
(74) *Attorney, Agent, or Firm* — J. Bennett Mullinax LLC

(57) ABSTRACT

An elevating platform assembly is provided. In accordance with one exemplary embodiment a platform is present and is moveable along a travel distance of a mast. A cylinder is provided and is capable of being actuated. The cylinder is used to move the platform along the travel distance.

18 Claims, 3 Drawing Sheets

OTHER PUBLICATIONS

PCT/US2008/010259, International Search Report, Nov. 4, 2008, 2 pages, ISA/US, Alexandria, Virginia.

Supplementary European Search Report issued by the EPO for EP Patent Application No. 08795701.5 to John W. Boyd, Dec. 16, 2011.

* cited by examiner

HYDRAULIC ELEVATING PLATFORM ASSEMBLY

FIELD OF THE INVENTION

The present invention relates generally to elevating platforms for use in raising and lowering workers at a construction or assembly site. More particularly, the present application involves a hydraulic elevating platform assembly that makes use of hydraulics to raise and lower a platform along a mast and to unlock a brake that normally locks the platform to the mast.

BACKGROUND OF THE INVENTION

Platform assemblies are used during construction in order to support workers and equipment at desired elevations. Platforms of this kind include stationary scaffolding that requires a significant amount of labor to set up and subsequently modify should a change in elevation be desired. As such, in order to save both time and labor elevating platform assemblies are useful for quickly and effortless moving workers and equipment to desired elevations. Elevating platform assemblies typically include a mast that is erected adjacent to the object being constructed or assembled. The mast carries a platform onto which the workers or equipment are supported. The platform can be moved vertically along the mast to a particular point and can be locked into place once the particular elevation is achieved.

One known way of moving the platform up and down along the mast involves the use of a drum and cable system. Here, a cable is attached to the platform and is wound around a drum that is located either on the mast or on the ground. Although suitable for their intended purpose, cable and drum systems are typically disfavored as a result of certain disadvantageous present in these types of designs.

Another means used to motivate platforms vertically along the mast is a rack and pinion drive assembly. The rack is oriented in a vertical manner along a portion of the mast. A plurality of drive pinions are rotatably mounted onto the platform. An appropriate driving means, such as a motor, is located on the platform and rotate the pinions in order to raise and lower the platform along the rack. A safety device such as an overspeed pinion can be incorporated in order to brake the platform along the rack should the platform travel too quickly.

Although rack and pinion systems are capable of moving a platform along the mast, the drive mechanism for the system is included on the platform. The pinion driving mechanism may take up space on the platform that could be used for holding workers or equipment. Additionally, should something happen to the pinion driving mechanism it cannot be repaired from the ground thus forcing additional, potentially costly, measures to be taken to remove the workers and equipment from the platform and to then access the platform to make the appropriate repairs. Also, the pinion and gearing components in the driving mechanism can be damaged through side impacts of the platform during loading and the construction process. These impacts on components could cause their failure, result in their damage thus reducing overall performance, and necessitate costly repair. As such, there remains room for variation and improvement within the art.

SUMMARY OF THE INVENTION

Various features and advantages of the invention will be set forth in part in the following description, or may be obvious from the description, or may be learned from practice of the invention.

One aspect of one exemplary embodiment provides for an elevating platform assembly that has a mast that carries a platform. The platform is moveable along a travel distance of the mast. A cylinder is present and is capable of being actuated. The cylinder is used to move the platform along the travel distance.

Another aspect of an additional exemplary embodiment resides in an elevating platform assembly as immediately discussed in which the cylinder is a hydraulic cylinder.

An additional aspect of a further exemplary embodiment includes an elevating platform assembly as previously mentioned that further has a cable that is used in order to place the cylinder into communication with the platform.

One aspect of another exemplary embodiment involves an elevating platform assembly as mentioned above that additionally includes a braking plate carried by the mast. The braking plate is arranged so as to extend substantially along the travel distance of the mast. A hydraulic brake is carried by the platform. The hydraulic brake is capable of engaging the braking plate in order to lock the position of the platform at a location along the travel distance of the mast.

Yet another aspect of a further exemplary embodiment is found in an elevating platform assembly as immediately discussed in which the hydraulic brake is normally locked so as to lock the position of the platform at a location along the travel distance of the mast. The hydraulic brake is capable of being hydraulically actuated in order to be unlocked so as to permit movement of the platform along the travel distance of the mast.

A further aspect of another exemplary embodiment includes an elevating platform assembly that has a mast and a platform carried by the mast. The platform is movable along a travel distance of the mast. A hydraulic cylinder capable of being actuated is included. Also present is a cable configured for transmitting motion of the hydraulic cylinder to the platform for use in moving the platform along the travel distance. A hydraulic brake is likewise included and is configured for locking the platform to the mast so that the mast is fixed at a particular position along the travel distance.

Another aspect of a further exemplary embodiment includes an elevating platform assembly as immediately mentioned in which the hydraulic brake has a pair of caliper brake pads carried by the platform. The mast has a braking plate that is arranged so as to extend substantially along the travel distance of the mast. The caliper brake pads are arranged on either side of the braking plate and are capable of engaging the braking plate in order to lock the hydraulic brake to lock the platform to the mast.

A further aspect of yet another exemplary embodiment includes an elevating platform assembly as mentioned previously in which the hydraulic brake is normally locked so as to lock the platform to the mast. The application of hydraulic pressure to the hydraulic brake acts to unlock the hydraulic brake so as to allow the platform to be moved along the travel distance.

One aspect of one exemplary embodiment provides for an elevating platform assembly that has a mast with a braking plate. A platform is carried by the mast and is movable along a travel distance of the mast. The braking plate is arranged so as to extend substantially along the travel distance. A hydraulic cylinder that is capable of being actuated is also present. A pulley system is included and is in communication with the hydraulic cylinder. Also present is a cable that is attached to the pulley system. The cable is configured for transmitting motion of the hydraulic cylinder to the platform for use in moving the platform along the travel distance. The pulley system is arranged so that an amount of movement of the hydraulic cylinder is translated into a greater amount of movement of the platform along the travel distance. A hydraulic brake is carried by the platform and is configured for engaging the braking plate in order to lock the platform to the mast. The hydraulic brake is normally locked so that the platform is locked to the mast. The hydraulic brake is capable of being hydraulically actuated so as to be urged into an unlocked configuration to allow the platform to move along the travel distance.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
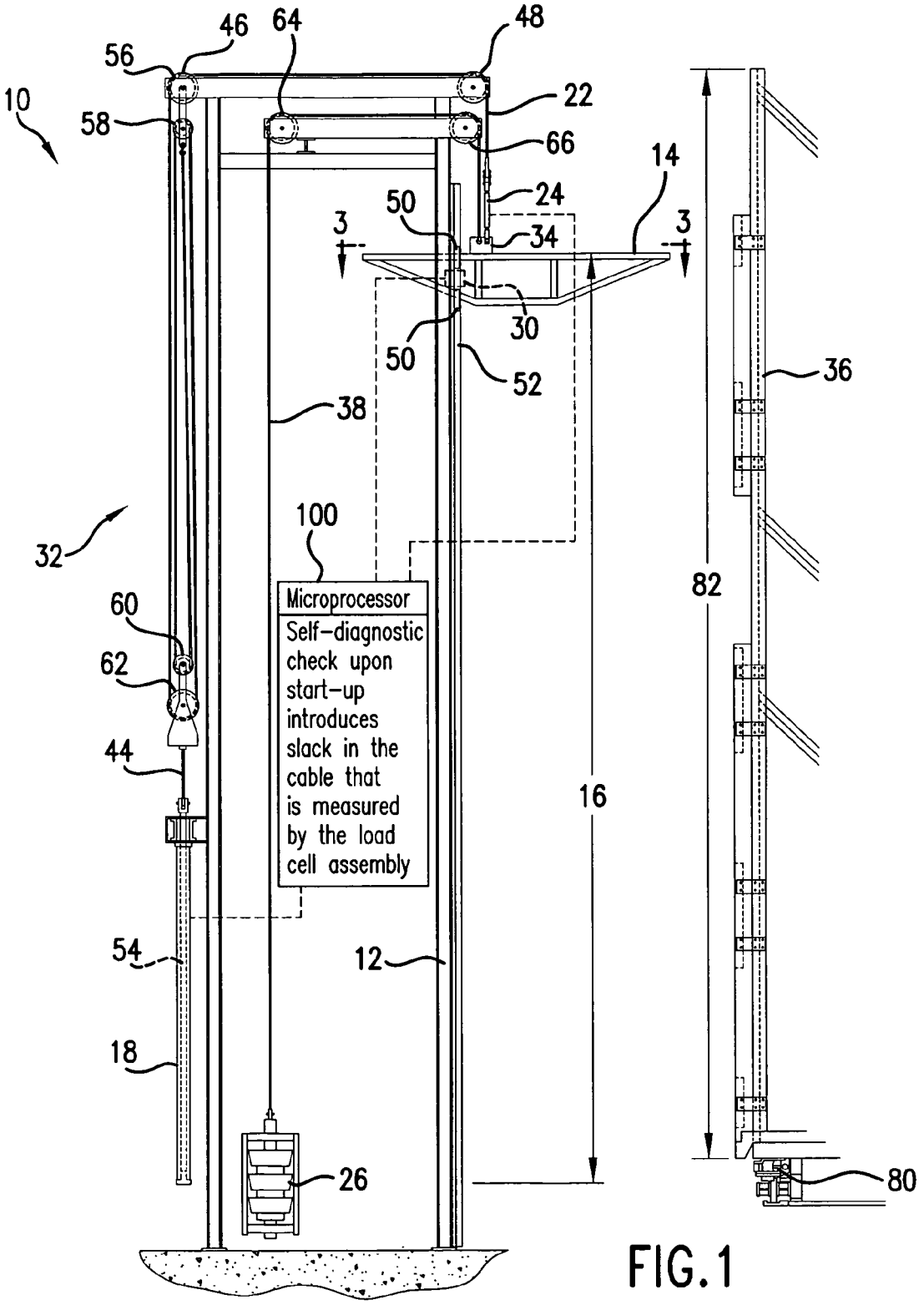
FIG. 1 is an elevation view of an elevating platform assembly with the platform in the upper raised position in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an elevating platform assembly 10 that can be used to position workers and equipment at different elevations at a construction or assembly site. The workers and/or equipment may be located on a platform 14 that is carried by a mast 12 and is movable vertically therewith. A cylinder 18 that may be a hydraulic cylinder 18 is provided and is actuated in order to move the platform 14 with respect to mast 12 so that the workers and/or equipment can be located at a desired elevation. A hydraulic brake 30 can also be included in order to lock the platform 14 to the mast 12. The hydraulic brake 30 can be arranged so that it is normally locked and must be actuated through hydraulic pressure in order to be unlocked so as to allow the platform 14 to be able to move with respect to mast 12.

One exemplary embodiment of the elevating platform assembly 10 is shown in FIG. 1. Here, the elevating platform assembly 10 is located adjacent a shell 36 that is used in the construction of a fiberglass tank. A worker may use elevating platform assembly 10 in order to be located at various elevations of the shell 36. The worker can spray fiberglass onto the shell 36 that may rotate about its axis, in order to form a wound fiberglass tank. Although shown for use in constructing a fiberglass tank, the elevating platform assembly 10 can be used in a variety of applications and it is to be understood that the disclosed application is but one example.

Figure 3:
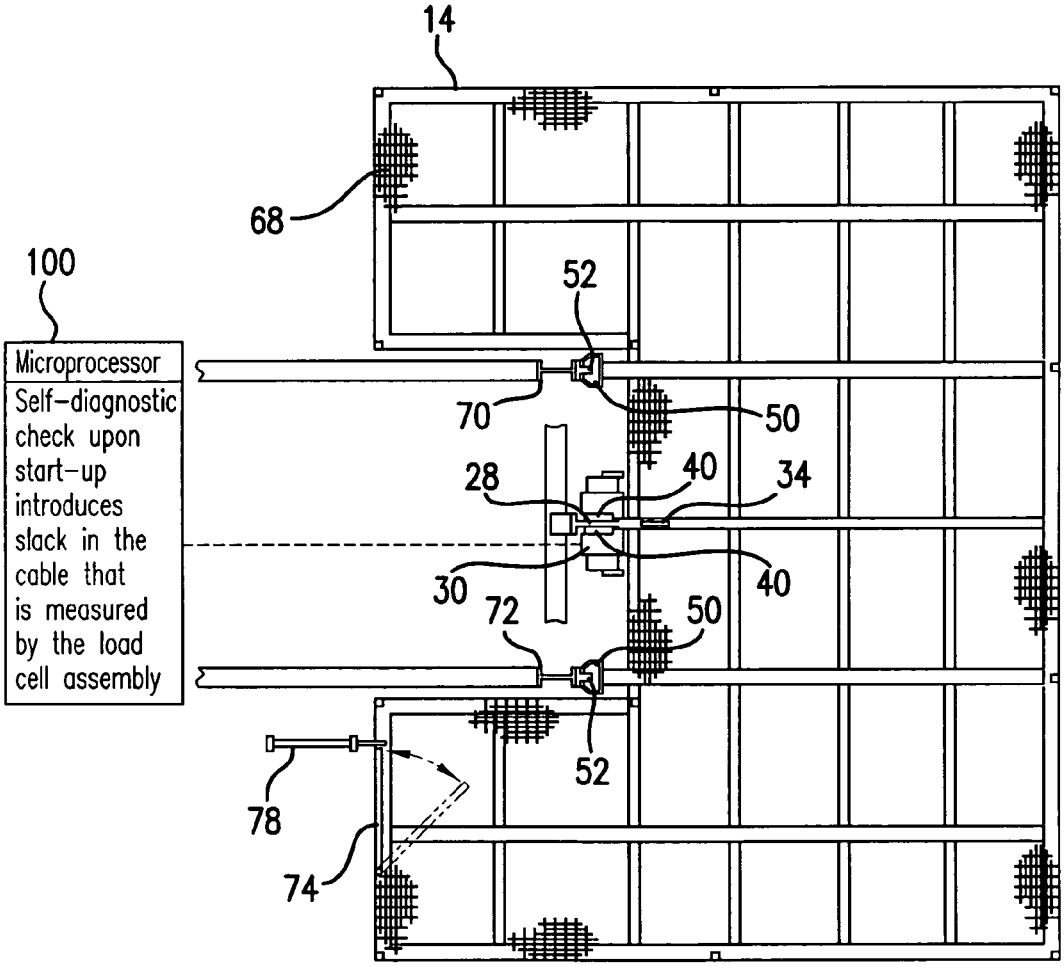
FIG. 3 is a section view taken along line 3-3 of FIG. 1.

The elevating platform assembly 10 includes a mast 12 that is made of a generally open steel framework. The mast 12 can include I-beams that are arranged vertically and are tied together though a system of interconnecting trusses. However, it is to be understood that the disclosed arrangement of mast 12 is but one example and that others are possible in accordance with various exemplary embodiments. A platform 14 is located at and can move along an end of mast 12. FIG. 3 is a section view taken along line 3-3 in FIG. 1 and shows various features of the platform 14. The platform 14 can be made by a series of longitudinally and laterally positioned steel members. A grate can be placed upon the steel members to form a floor 68 of platform 14 onto which workers and equipment may rest. Although not shown for purposes of clarity, safety railing can extend from the floor 68 of platform 14 to help contain workers and equipment therein. A gate 74 is also present in order to afford a portal through which workers and equipment may be transported onto and off of the platform 14. The mast 12 includes an emergency ladder 78 that extends vertically along mast 12 and is located proximate to the gate 74 of platform 14 throughout its travel distance 16. Should the platform 14 become disabled the emergency ladder 78 can be utilized in order to evacuate workers from the platform 14 or to allow repair personal to access the platform 14 and other areas of the mast 12.

The mast 12 has a pair of I-beams 70 and 72 located on the same side of mast 12 as the platform 14. Each of the I-beams 70 and 72 carry a track 52 along at least a portion of their lengths. Platform guide bearings 50 are carried by the platform 14 and engage the track 52. The platform 14 is thus rendered mobile with respect to the mast 12. Additional guide bearings 50 are located below the two illustrated in FIG. 3 so that a total of four guide bearings 50 are present in the described elevating platform assembly 10. However, it is to be understood that other arrangements of the elevating platform assembly 10 are possible in which any number of guide bearings 50 can be employed. For example, up to sixteen guide bearings 50 can be used in accordance with various exemplary embodiments. Further, it is to be understood that the described manner of rendering the platform 14 mobile with respect to the mast 12 is but one example and that others are possible.

FIG. 1 shows the platform 14 in its upper most location on mast 12. The elevating platform assembly 10 is designed so that the platform 14 has a travel distance 16 along mast 12. The travel distance 16 may be sixty feet in accordance with one exemplary embodiment when the elevating platform assembly 10 is used to construct a fiberglass tank. Other embodiments are possible in which the travel distance 16 may be from thirty to two hundred feet. A counterweight 26 is included that is used to at least partially balance the weight of platform 14 and its associated cargo. The counterweight 26 is attached to a counterweight cable 38 that engages sheaves 64 and 66 that are rotatably mounted onto an upper portion of the mast 12. The counterweight cable 38 can be three quarter inch diameter 6×37 wire rope in accordance with one embodiment. It is to be understood that as used herein, the term "cable" is broad enough to encompass wire, rope, any combination of the two or any other equivalent structure. The sheaves 64 and 66 may be fourteen inch outer diameter #S14ACF sheaves in accordance with one exemplary embodiment. The counterweight cable 38 is attached on an opposite end to a lifting lug 34 of the platform 14. Although the counterweight 26 can be selected to be of any desired weight, in certain embodiments the counterweight 26 is sized so as to be approximately three hundred pounds less than the dead weight of the platform 14. In this manner, should approximately three hundred pounds of weight be placed onto the platform 14 by way of workers and/or equipment the resulting arrangement will only need a minimal amount of force to be applied thereto in order to move the platform 14 to a desired location. Additionally, should the applied force or braking device fail, the presence of counterweight 26 will act to balance the platform 14 so that it does not uncontrollably fall along mast 12.

The platform 14 is moved along the travel distance 16 through the use of a cylinder 18. The cylinder 18 may be any type of cylinder. For example, the cylinder 18 can be a pneumatic cylinder or may be a hydraulic cylinder in accordance with various embodiments. In the embodiment shown, cylinder 18 is a hydraulic cylinder 18. Also, in accordance with one exemplary embodiment the hydraulic cylinder 18 has a four inch bore, one hundred and eighty inches of stroke 20, and is operated at three thousand PSI. Although not shown, a hydraulic fluid source, a hydraulic fluid pump, a pressure relief valve and other components common to a hydraulic system may be present in order to actuate the hydraulic cylinder 18. Actuation of the hydraulic cylinder 18 causes movement of a cable 22 that is attached to the platform 14 on one end. Sheaves 46 and 48 are present and are rotatably attached to an upper portion of the mast 12. The sheaves 46 and 48 may be fourteen inch outer diameter #S14ACF sheaves in one embodiment. The cable 22 is supported along a portion of its length by the sheaves 46 and 48.

Figure 2:
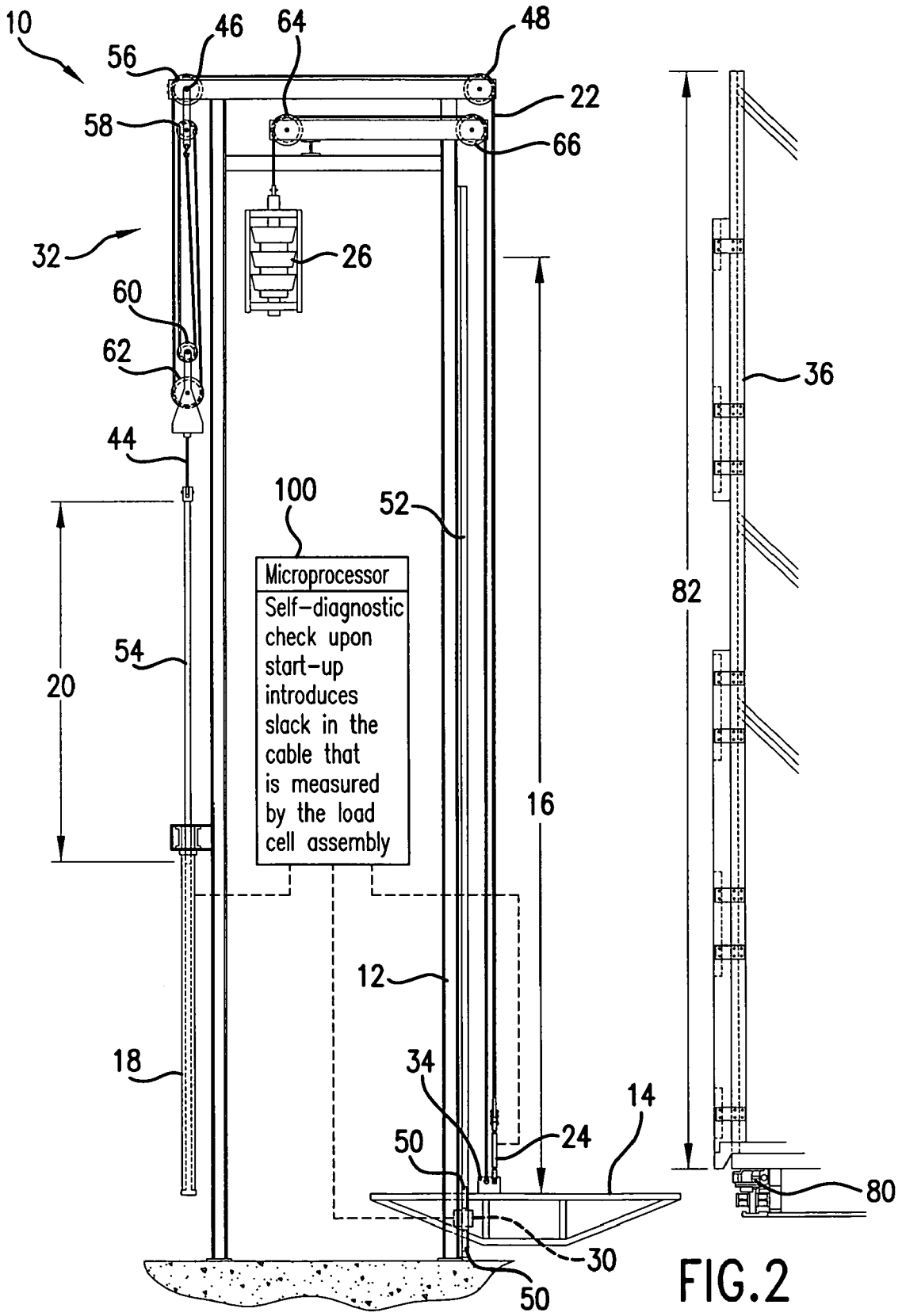
FIG. 2 is an elevation view of the elevating platform assembly of FIG. 1 with the platform in the bottom lowered position.

Application of hydraulic pressure to a rod 54 in the hydraulic cylinder 18 causes the rod 54 to be moved in the vertical direction as shown in FIG. 2. The rod 54 has a stroke 20. Movement of the rod 54 causes a corresponding movement of cable 22 that in turn cause a movement of platform 14 along the travel distance 16. The elevating platform assembly 10 can be arranged so that for every foot of movement of the rod 54 the platform 14 experiences one foot of movement along mast 12 in the travel distance 16. Other arrangements are possible so that a particular stroke 20 of rod 54 translates into a greater distance of movement of platform 14 along the travel distance 16. FIGS. 1 and 2 show one such embodiment in which a pulley system 32 is employed in order to cause a particular stroke 20 to be translated into a greater distance of movement of the platform 14. A pulley system 32 is present in order to cause a particular distance of travel of rod 54 to be translated into a greater distance of travel of platform 14. The pulley system 32 employs a pair of double pulleys for causing a 4:1 distance translation. The cable 22 runs over a first pulley 56 that in this case is the sheave 46. Cable 22 is then run down across a fourth pulley 62 and subsequently back up and across a second pulley 58 that is rigidly connected to the first pulley 56. From here, the cable 22 runs down and across a third pulley 60 that is rigidly connected to the fourth pulley 62. Finally, cable 22 runs from the third pulley 60 upwards and is connected on its end to a hook extending from the second pulley 58. A hydraulic cylinder cable 44 can be present and can connect the fourth pulley 62 to an end of the rod 54.

The cable 22 can be a three quarter inch 6×37 wire rope in accordance with one exemplary embodiment. The pulley system 32 thus makes use of a four part load line in order to achieve a desired distance translation. In one embodiment, the pulley system 32 can be a Crosby McKissick 680 block with two fourteen inch diameter sheaves. The model number for this type of pulley system 32 is C10D14BH and is provided by the Crosby Group, Inc. having corporate headquarters at 2801 Dawson Rd., Tulsa, Okla. 74110.

FIG. 1 shows the hydraulic cylinder 18 arranged so that the rod 54 is located at its lowest vertical position. The hydraulic cylinder cable 44 is likewise pulled to its lowest vertical position which forces the pulley system 32 to be extended so that the pulleys 56 and 58 are located their greatest distance from pulleys 60 and 62. Cable 22 is thus arranged so that the platform 14 is located at its upper most position on the mast 12. When the platform 14 is at this position, the counterweight 26 is located at its lowest vertical position. Application of hydraulic pressure to the bottom of rod 56, or alternatively lowering of hydraulic pressure on the upper side of rod 56, causes it to be moved vertically upwards into the position shown in FIG. 2. Here, the rod 56 has been actuated so that it has traversed its entire stroke 20. Doing so causes the pulley system 20 to be moved so that the pulleys 56 and 58 are located in close proximity to the pulleys 60 and 62. The pulley system 32 is thus moved generally upwards which causes the cable 22 to be moved generally to the right in FIG. 2 so that the platform 14 is moved into its lowest vertical position. The counterweight 26 is likewise moved in response to force being varied to the platform 14 so that it is located in its highest vertical position in FIG. 2.

Movement of the full stroke 20 of the hydraulic cylinder 18 between FIGS. 1 and 2 causes the platform 14 to be moved between its highest and lowest point. As the distance ratio of the pulley system 32 is 4:1, the platform 14 is moved four times as far as the rod 54 upon comparison between FIGS. 1 and 2. In the exemplary embodiment shown, the stroke 20 of rod 54 is fifteen feet thus resulting in sixty feet of travel of the platform 14 along the travel distance 16. Although the presence of pulley system 32 causes a desired travel increase of platform 14 it necessarily causes a greater force to be applied by the hydraulic cylinder 18 in effecting this increase. Typically, if a 4:1 travel ratio is achieved through the pulley system 32 the hydraulic cylinder 18 must exert four times the weight of platform 14 in order to effect this movement. However, the presence of counterweight 26 can cause this force to be relatively small and within the operating limits of the hydraulic cylinder 18. Also, friction in the pulley system 32 and along the sheaves 46 and 48 will result in a less than 4:1 ratio of force being needed. Application or removal of hydraulic pressure to the top of rod 54 can cause the rod 54 to be moved vertically lower so that the platform 14 and other previously discussed components are moved back into the positions shown in FIG. 1.

The elevating platform assembly 10 may include a hydraulic brake 30 for use in locking the platform 14 to the mast 12 so that its position along the travel distance 16 does not change. A braking plate 28 can be arranged on the mast 12 so that it extends in the vertical direction. The braking plate 28 may extend the entire length of the travel distance 16 and can be connected to an I-beam or other member making up the mast 12. A hydraulic brake 30 can be carried by the platform 14 and can be of a caliper type. In accordance with one exemplary embodiment, hydraulic brake 30 is a TWIFLEX® brake of The Hilliard Corporation having offices located at 100 West Fourth Street, Elmira, N.Y. 14902-1504. The hydraulic brake 30 has a pair of caliper brake pads 40 that engage the braking plate 28 in order to lock the position of the platform 14 with respect to the mast 12. The caliper brake pads 40 are normally urged to the locked position so that they engage the braking plate 28, and hence lock the platform 14 in place, without the application of any hydraulic pressure to the hydraulic brake 30. In this regard, springs or other urging components or other configurations can be implemented to cause the hydraulic brake 30 to be normally locked. The locking force can be such that application of full hydraulic pressure to hydraulic cylinder 18 does not cause enough force to be imparted onto platform 14 to overcome the locking force of hydraulic brake 30.

The hydraulic brake 30 may thus cause the platform 14 to remain locked in place in the travel distance 16 should an event such as a snapping of cable 22 or counterweight cable 38 occur. Further, the loss of hydraulic pressure will not function to drop the platform 14 as the hydraulic brake 30 is normally locked onto the braking plate 28 without the need of hydraulic pressure. When a user wants to move the platform 14, hydraulic pressure can be applied to the hydraulic brake 30 in order to cause the hydraulic brake 30 to become unlocked. In this regard, the caliper brake pads 40 will disengage from the braking plate 28 to allow the platform 14 to move along the mast 12 in the travel distance 16. However, due to particular loading on the platform 14, the amount of counterweight 26 present, or the application or non-application of hydraulic pressure to the hydraulic cylinder 18 the platform 14 may or may not move. Hydraulic pressure can then be applied to the hydraulic cylinder 18 in a desired fashion in order to move the platform 14 either up or down in the travel distance to a desired elevation on the mast 12. Although shown as incorporating both a cylinder 18 and a hydraulic brake 30, it is to be understood that other arrangements of the elevating platform assembly 10 need not have both of these components or be configured in the illustrated and described manners. For example, in one particular embodiment, the elevating platform assembly 10 can have a hydraulic brake 30 but does not include a cylinder 18.

The elevating platform assembly 10 may also feature a self-diagnostic check upon start-up. A load cell assembly 24 can be included and may be attached on one end to the cable 22 and on the other end to the lifting lug 34 of the platform 14. The load cell assembly 24 can measure the amount of tension in the cable 22. Once the elevating platform assembly 10 is turned on, the system can introduce slack in the cable 22 that is measured by the load cell assembly 24. Slack in cable 22 may be representative of a fall of the platform 14, snapping of cable 22, or a loss of hydraulic pressure to the hydraulic cylinder 18. The self-diagnostic may be able to recognize slack in cable 22 and ensure that sufficient locking force is provided by the hydraulic brake 30 to ensure that the platform 14 does not fall vertically along the mast 12. Also, the self-diagnostic feature may be capable of imparting tension onto the cable 22 that can be read by the load cell assembly. Excessive tension on cable 22 may be indicative of too much weight being placed onto the platform 14. The self-diagnostic feature can detect the excessive tension on cable 22 and ensure that sufficient braking force is being applied by the hydraulic brake 30 and/or that sufficient holding force is being applied by the hydraulic cylinder 18 to ensure that platform 14 does not fall.

Although described as being implemented in a self-diagnostic check, the aforementioned checks and corrections can be implemented during operation of the elevating platform assembly 10 if desired. Various systems of the elevating platform assembly 10 can be in communication with a microprocessor 100 that is capable of providing corrective action to the assembly 10 based upon measured readings. If too little tension is sensed in the cable 22, the safety system may function to shut down the cylinder 18 and apply the hydraulic brake 30 to lock the platform 14 in place. Should too much tension be measured in the cable 22, the cylinder 18 can once again be shut down and the hydraulic brake 30 can be applied to lock the platform 14 in place.

The elevating platform assembly 10 is located next to a shell 36 as shown in FIGS. 1 and 2. Shell 36 is used in the construction of a fiberglass tank. Track 80 is present so that the shell 36 can be rotated about its axis. The mast 12 can be constructed so that the platform 14 is capable of traversing the entire shell height 82 of shell 36. During construction of the fiberglass tank, the shell 36 can be rotated about track 80 and fiberglass can be applied by a worker standing on the floor 68 of platform 14. The worker is positioned proximate to shell 36 through the placement of platform 14 and can apply the fiberglass via an applicator. Once a desired amount of fiberglass has been applied to a particular spot of the shell 36, the platform 14 can be raised so that a new section of shell 36 is exposed for the application of fiberglass thereon. The rotation of shell 36 and movement of platform 14 can be made manually or automatically. Further, their movements can be synchronized with one another in accordance with one exemplary embodiment. For example, a microprocessor may be capable of recognizing the rotation of shell 36 such that the platform 14 is moved in response so that an even amount of fiberglass is applied to each section of the shell 36.

Although described as being capable of traversing the entire shell height 82, the platform 14 may be capable of traversing only a portion of the shell height 82 in other embodiments. Further, although described as being positioned adjacent a shell 36 for use in manufacturing a fiberglass tank, the elevating platform assembly 10 need not be used for this purpose in other embodiments. In this regard, the elevating platform assembly 10 can be used in a variety of applications in which the elevation of workers or equipment is desirable. When used for the purposes of manufacturing a fiberglass tank, the tank can be constructed in a manner described in U.S. patent application Ser. No. 11/323,215 filed on Dec. 30, 2005 titled "Apparatus and Method for Making Large Diameter Wound-Fiber Reinforced Tanks" the entire contents of which are incorporated herein by reference in their entirety for all purposes.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An elevating platform assembly, comprising:

a mast;

a platform carried by said mast and moveable along a travel distance of said mast;

a cylinder capable of being actuated, wherein said cylinder is used to move said platform along the travel distance;

a counterweight attached to said platform and not directly attached to said cylinder, wherein said cylinder is attached to said platform, wherein said cylinder is indirectly attached to said counterweight through said platform by way of attachment of both said cylinder and said counterweight to said platform;

a cable that is used to place said cylinder into communication with said platform;

a brake that applies a locking force to lock said platform at a location along the travel distance, wherein the locking force is strong enough to prevent movement of said platform along the travel distance when full pressure is applied to said cylinder; and a load cell assembly configured for measuring an amount of tension in said cable, wherein a microprocessor performs a self-diagnostic check upon start-up that introduces slack in said cable that is measured by said load cell assembly to ensure that said platform does not fall along said mast, and wherein said self-diagnostic check upon start-up introduces tension in said cable that is measured by said load cell assembly, and wherein actuation of said cylinder in opposite directions imparts the slack and tension to said cable when the locking force prevents movement of the platform along the travel distance.

2. The elevating platform assembly as set forth in claim 1, further comprising:

a braking plate carried by said mast, wherein said braking plate is arranged so as to extend substantially along the travel distance of said mast; and wherein said brake is a hydraulic brake carried by said platform, wherein said hydraulic brake is capable of engaging said braking plate in order to lock the position of said platform at a location along the travel distance of said mast.

3. The elevating platform assembly as set forth in claim 2, wherein said hydraulic brake is normally locked so as to lock the position of said platform at a location along the travel distance of said mast, and wherein said hydraulic brake is capable of being hydraulically actuated in order to be unlocked so as to permit movement of said platform along the travel distance of said mast.

4. The elevating platform assembly as set forth in claim 1, wherein said cylinder is a hydraulic cylinder.

5. The elevating platform assembly as set forth in claim 1, wherein said load cell assembly is attached on one end to said cable and on an opposite end to said platform to effect attachment of said cylinder to said platform.

6. The elevating platform assembly as set forth in claim 1, wherein said counterweight is movable with respect to said mast, wherein the weight of said counterweight is less than the dead weight of said platform.

7. The elevating platform assembly as set forth in claim 1, further comprising a pulley system configured for translating a distance of movement of said cylinder into a greater distance of movement of said platform along the travel distance.

8. The elevating platform assembly as set forth in claim 1, wherein actuation of said cylinder is synchronized with rotation of a shell adjacent to said platform such that said platform is moved along the travel distance as said shell rotates in order to aid in applying fiberglass to the shell to form a fiberglass tank.

9. An elevating platform assembly, comprising:

a mast;

a platform carried by said mast and movable along a travel distance of said mast;

a hydraulic cylinder capable of being actuated;

a cable configured for transmitting motion of said hydraulic cylinder to said platform for use in moving said platform along the travel distance;

a hydraulic brake configured for locking said platform to said mast such that said platform is fixed at a particular position along the travel distance, wherein said brake applies a locking force to lock said platform at a location along the travel distance, wherein the locking force is strong enough to prevent movement of said platform along the travel distance when full pressure is applied to said cylinder; and a load cell assembly directly attached on one end to said cable, wherein said load cell assembly is capable of detecting slack in said cable, wherein a microprocessor performs a self-diagnostic check upon start-up that introduces slack in said cable that is measured by said load cell assembly to ensure that said platform does not fall along said mast, and wherein said self-diagnostic check upon start-up introduces tension in said cable that is measured by said load cell assembly, and wherein actuation of said cylinder in opposite directions imparts the slack and tension to said cable when the locking force prevents movement of the platform along the travel distance.

10. The elevating platform assembly as set forth in claim 9, further comprising a pulley system located between said cable and said hydraulic cylinder, wherein said pulley system is configured for transmitting motion of said hydraulic cylinder to said cable, wherein said pulley system is configured so that a specific distance of movement of said hydraulic cylinder is translated into a greater distance of movement of said platform along the travel distance.

11. The elevating platform assembly as set forth in claim 10, further comprising a hydraulic cylinder cable connecting said hydraulic cylinder to said pulley system, wherein said pulley system is arranged so as to translate approximately one foot of movement of said hydraulic cylinder into approximately four feet of movement of said platform along the travel distance.

12. The elevating platform assembly as set forth in claim 9, further comprising a counterweight cable used to attach said counterweight to said platform, wherein said counterweight is supported by said mast and is movable with respect to said mast, and wherein the weight of said counterweight is less than the dead weight of said platform.

13. The elevating platform assembly as set forth in claim 9, wherein said hydraulic brake has a pair of caliper brake pads carried by said platform, and wherein said mast has a braking plate that is arranged so as to extend substantially along the travel distance of said mast, wherein said caliper brake pads are arranged on either side of said braking plate and are capable of engaging said braking plate in order to lock said hydraulic brake to lock said platform to said mast.

14. The elevating platform assembly as set forth in claim 9, wherein said hydraulic brake is normally locked so as to lock said platform to said mast, wherein application of hydraulic pressure to said hydraulic brake acts to unlock said hydraulic brake so as to allow said platform to be moved along the travel distance.

15. The elevating platform assembly as set forth in claim 9, wherein actuation of said hydraulic cylinder is synchronized with rotation of a shell adjacent to said platform such that said platform is moved along the travel distance as said shell rotates in order to aid in applying fiberglass to the shell to form a fiberglass tank.

16. The elevating platform assembly as set forth in claim 9, further comprising a pair of sheaves mounted onto said mast, wherein said cable engages both of said sheaves.

17. The elevating platform assembly as set forth in claim 9, further comprising at least one platform guide bearing carried by said platform, wherein said mast has a track that is engaged by said platform guide bearing in order to render said platform movable with respect to said mast.

18. An elevating platform assembly, comprising:

a mast, wherein said mast has a braking plate;

a platform carried by said mast and movable along a travel distance of said mast, wherein said braking plate is arranged so as to extend substantially along the travel distance;

a hydraulic cylinder capable of being actuated;

a pulley system in communication with said hydraulic cylinder;

a cable attached to said pulley system, wherein said cable is configured for transmitting motion of said hydraulic cylinder to said platform for use in moving said platform along the travel distance, wherein said pulley system is arranged so that an amount of movement of said hydraulic cylinder is translated into a greater amount of movement of said platform along the travel distance;

a hydraulic brake carried by said platform and configured for engaging said braking plate in order to lock said platform to said mast, wherein said hydraulic brake is normally locked so that said platform is locked to said mast, wherein said hydraulic brake is capable of being hydraulically actuated so as to be urged into an unlocked configuration to allow said platform to move along the travel distance, wherein said brake applies a locking force to lock said platform at a location along the travel distance, wherein the locking force is strong enough to prevent movement of said platform along the travel distance when full pressure is applied to said cylinder;

a counterweight attached to said platform and not directly attached to said hydraulic cylinder, wherein said cable is used to attach said hydraulic cylinder to said platform, wherein said hydraulic cylinder is indirectly attached to said counterweight through said platform by way of attachment of both said hydraulic cylinder and said counterweight to said platform; and a load cell assembly configured for measuring an amount of tension in said cable, wherein a microprocessor performs a self-diagnostic check upon start-up that introduces slack in said cable that is measured by said load cell assembly and imparts tension onto said cable that is measured by said load cell assembly to ensure that said platform does not fall along said mast, wherein actuation of said cylinder in opposite directions imparts the slack and tension to said cable when the locking force prevents movement of the platform along the travel distance.

* * * * *